US007547158B1

(12) United States Patent
Mucci

(10) Patent No.: US 7,547,158 B1
(45) Date of Patent: Jun. 16, 2009

(54) SYSTEM AND METHOD FOR INSTALLING EXPANSION JOINTS IN POURED SLABS OF CONCRETE

(76) Inventor: James Mucci, 716 S. Towamencin Ave., Lansdale, PA (US) 19446

( * ) Notice: Subject to any disclaimer, the term of this patent is extended or adjusted under 35 U.S.C. 154(b) by 0 days.

(21) Appl. No.: 11/975,640

(22) Filed: Oct. 22, 2007

(51) Int. Cl.
*E01C 11/02* (2006.01)
*E01C 11/04* (2006.01)
*E01C 11/06* (2006.01)

(52) U.S. Cl. ..... 404/47; 404/48; 404/67; 404/68; 52/396.02

(58) Field of Classification Search ..... 404/47–69; 52/396.02–396.05
See application file for complete search history.

(56) References Cited

U.S. PATENT DOCUMENTS 1,033,431 A * 7/1912 McCarthy ..... 404/47
2,016,858 A * 10/1935 Hall ..... 404/68
2,662,342 A * 12/1953 Peterson ..... 47/33
3,335,647 A * 8/1967 Thorp, Jr. ..... 404/87
3,733,647 A * 5/1973 Jakel ..... 16/16
4,012,159 A * 3/1977 Berry ..... 404/68
4,127,352 A * 11/1978 Peters ..... 404/74
4,198,176 A 4/1980 Bentz ..... 404/68
4,875,801 A 10/1989 Montrym ..... 404/48
4,936,704 A 6/1990 Killmeyer ..... 404/74
5,375,386 A * 12/1994 Goad ..... 52/396.03
6,598,364 B1 * 7/2003 Pelles ..... 52/396.02

* cited by examiner

*Primary Examiner*—Raymond W Addie
(74) *Attorney, Agent, or Firm*—LaMorte & Associates

(57) ABSTRACT

An expansion joint and the corresponding method of setting an expansion joint between adjacent slabs of poured concrete. To form the expansion joint a filler strip is provided. To protect the filler strip, a protective cap element is provided. The protective cap element has a top surface and opposing side surfaces. The structure of the protective cap element creates a long central groove. Pin corrals extend from the side surfaces of the protective cap element. The protective cap element is placed over the filler strip so that the filler strip is disposed within the groove. The protective cap element and the filler strip are anchored by driving anchor pins through at least some of the pin corrals. Concrete is then poured against the filler strip and the protective cap element, wherein the concrete envelops the pin corrals that are not engaging anchor pins.

10 Claims, 6 Drawing Sheets

SYSTEM AND METHOD FOR INSTALLING EXPANSION JOINTS IN POURED SLABS OF CONCRETE

BACKGROUND OF THE INVENTION

1. Field of the Invention

In general, the present invention is related to devices that are used to hold expansion joints in place as concrete is poured. More particularly, the present invention relates to devices that help anchor and protect the expansion joints after the poured concrete has hardened.

2. Prior Art Description

When concrete is poured as pavement on streets, sidewalks and driveways, the concrete is rarely poured as a single form. Rather, the concrete is poured into smaller sections. The various smaller sections are divided by expansion joints. Concrete, like many other materials, expands and contracts in response to changes in temperature and humidity. Furthermore, the earth under a poured concrete surface may settle over time. The use of expansion joints enables different segments of concrete slab to settle in different degrees. The use of expansion joints, therefore, enables a concrete slab to compensate for stresses without cracking, thereby significantly increasing the useful life of the concrete slab.

There are many different types of expansion joints that have been used between adjacent concrete slabs. Some expansion joints are merely a wide open groove. However, such grooves fill with dirt and debris and soon harbor weeds and other plants. Furthermore, the roots of the growing plants can cause damage to the poured concrete, thereby greatly reducing the span of its functional life. To prevent plant growth, expansion joints are most often formed using a filler strip. The filler strip fills the expansion joint and prevents dirt and debris from gathering in the expansion joint.

Filler strips for concrete expansion joints are made from a material that is far softer than concrete. In this manner, when the concrete expands and contracts, the filler strip can absorb the forces without cracking the concrete. Filler strips are often just planks of wood. However, synthetic filler strips are also commercially available.

Wood plank filler strips are popular because they are widely available, come in a variety of precut sizes and are inexpensive. Furthermore, wooden plank filler strips can also be used to form an edge during the pouring of concrete. Consequently, a contractor can box off an area of concrete with wooden planks, pour the concrete into the form, and then leave the wooden planks in place as expansion joints.

The problem with wooden plank filler strips is that they tend to rot over time. The expansion joint, therefore, decomposes allowing weeds to take root in the expansion joint. In an attempt to prolong the life of an expansion joint, a contractor may use a synthetic filler strip. Synthetic filler strips tend to be far more flexible than planks of wood. Accordingly, if a synthetic filler strip is used, it cannot be used as a form edge unless it is strongly reinforced. The application of a synthetic expansion joint, therefore, can be far more labor intensive than a comparable wooden filler strip.

To assist in the application of both wooden filler strips and synthetic filler strips, anchoring systems have been developed that are designed to hold the filler strips in place as concrete is poured. In this manner, less labor is involved in reinforcing the filler strips prior to the pouring of concrete. Such prior art anchoring systems typically support the filler strip from the bottom of the filler strip. In this manner, the anchoring system becomes completely submersed by the poured concrete and cannot be seen. Such bottom support prior art anchoring systems are exemplified by U.S. Pat. No. 4,198,176 to Bentz, entitled Concrete Expansion Joint Forming Structure; U.S. Pat. No. 4,875,801 to Montrym, entitled Expansion Joint Brace And Aligner; and U.S. Pat. No. 4,936,704 to Killmeyer, entitled Expansion Joint Filler Strip Holder.

Bottom support anchoring systems are typically expensive and are difficult to cut to specific lengths. Furthermore, since the anchoring system engages the filler strip at the bottom of the filler strip, the anchoring system provides no support to the top of the filler strip. Lastly, such bottom support anchoring systems fail to provide any physical protection to the top of the filler strip that is exposed to the elements.

A need therefore exists for an anchoring system for an expansion joint filler strip that is low-cost, easy to adjust, and wherein the anchoring system both supports and protects the top of the filler strip. This need is met by the present invention as described and claimed below.

SUMMARY OF THE INVENTION

The present invention is an expansion joint and the corresponding method of setting an expansion joint between two adjacent slabs of poured concrete. To form the expansion joint a filler strip having a top edge and a bottom edge is provided. To protect the filler strip, a protective cap element is provided. The protective cap element has a top surface and opposing side surfaces. The structure of the protective cap element creates a groove that extends the length of the protective cap element between the top surface and the two opposing side surfaces.

Pin corrals extend from the side surfaces of the protective cap element. The protective cap element is placed over the filler strip so that the top edge of the filler strip is disposed within the groove. The protective cap element and the filler strip are anchored in a fixed position by driving anchor pins through at least some of the pin corrals. Concrete is then poured against the filler strip and the protective cap element, wherein the concrete envelops the pin corrals that are not engaging anchor pins. The result is a filler strip that is anchored and covered by the protective cap element. The filler strip is therefore protected from the elements and contact damage, thereby producing a longer lasting expansion joint.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
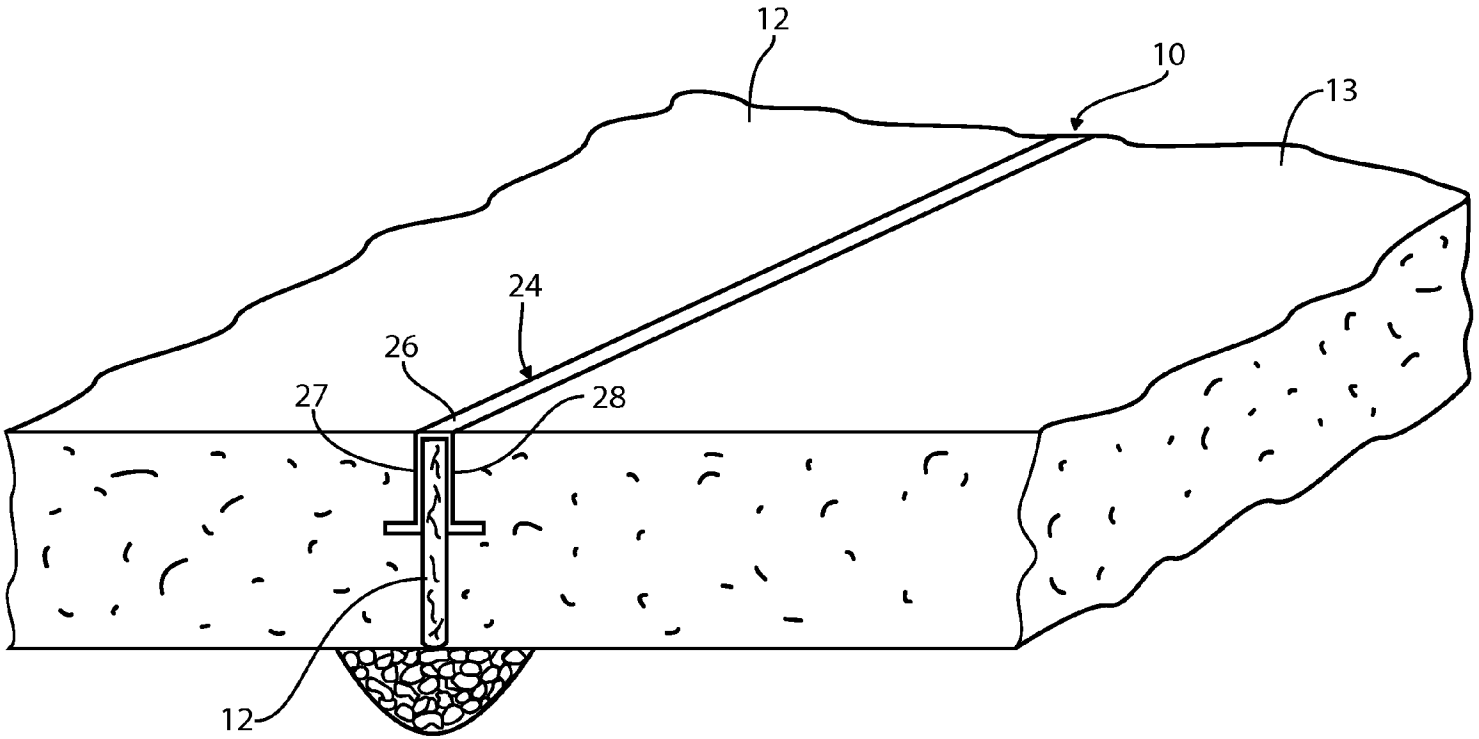
FIG. 1 is a perspective view of an exemplary embodiment of an expansion joint between two slabs of concrete.
Figure 2:
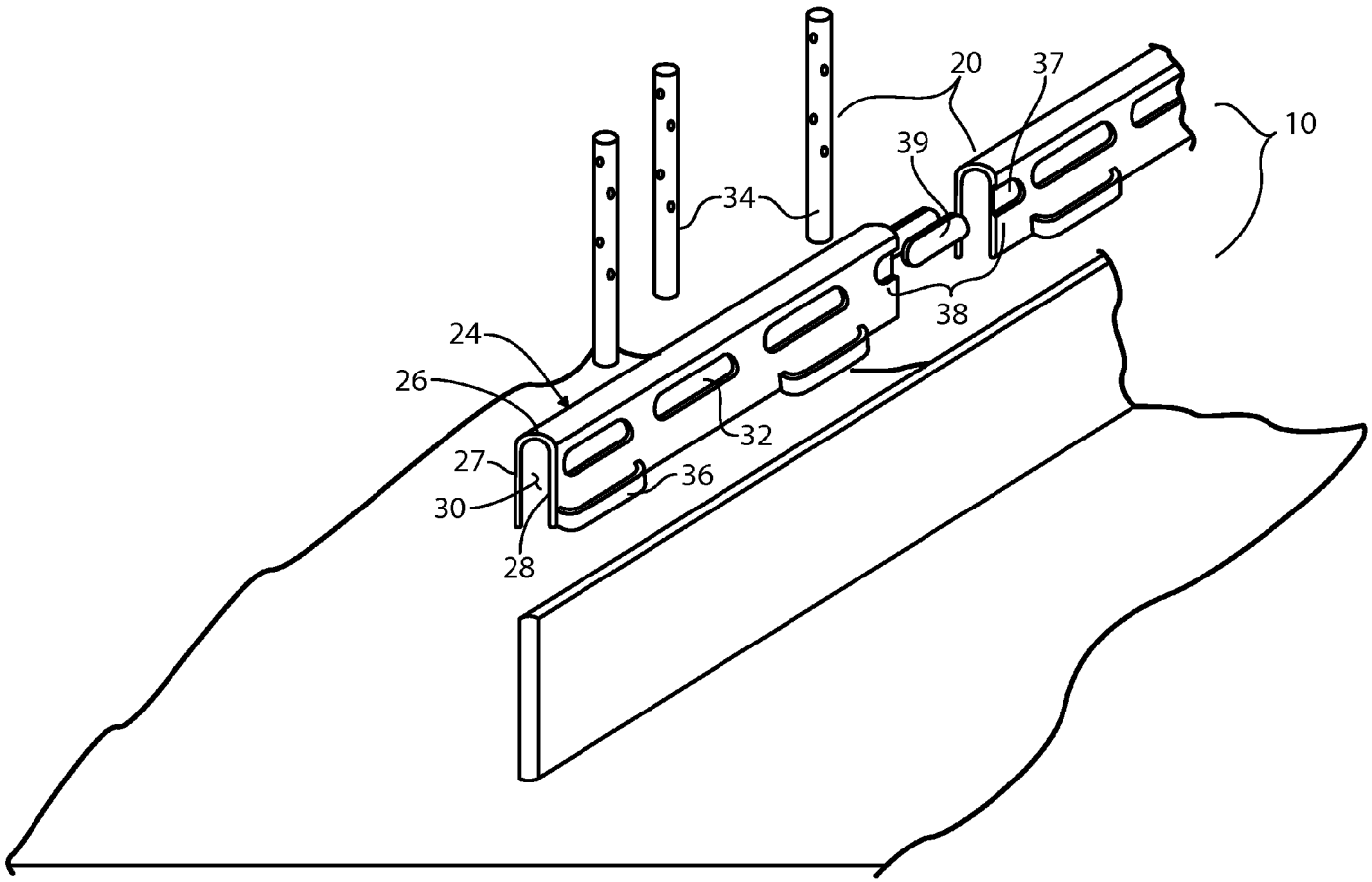
FIG. 2 is an exploded view of the embodiment of FIG. 1.

Referring to FIG. 1 in conjunction with FIG. 2, an exemplary expansion joint 10 is shown that separates two adjacent slabs 12, 13 of poured concrete. The expansion joint 10 consists of a filler strip 20 and an anchoring system 22 that is used to hold the filler strip 20 in place when the slabs of poured concrete are initially created.

In the shown embodiment, the filler strip 20 is illustrated as a plank of wood. However, it will be understood that a length of a synthetic filler strip can be used in place of the wooden plank and that the wooden plank is being used only as an example.

The anchoring system 22 includes a series of interconnecting protective cap elements 24. Each protective cap element 24 has a top surface 26 and two opposing side surfaces 27, 28 that define a groove 30, whereby the groove 30 has an inverted U-shape. The width of the groove 30 matches the width of the filler strip 20 and is typically either ¾ inches or one inch. The side surfaces 27, 28 of the protective cap element 24 can have any height, but are preferably between two inches and eight inches high. The protective cap element 24 can be made of a corrosion resistant metal, such as galvanized steel, copper or aluminum. However, in the preferred embodiment, the protective cap element 24 is made of a UV resistant plastic, such as polyvinylchloride. It will therefore be understood that the protective cap element 24 can be made in a variety of different colors by adding colorant to the plastic material prior to the formation of the protective cap element 24.

Figure 3:
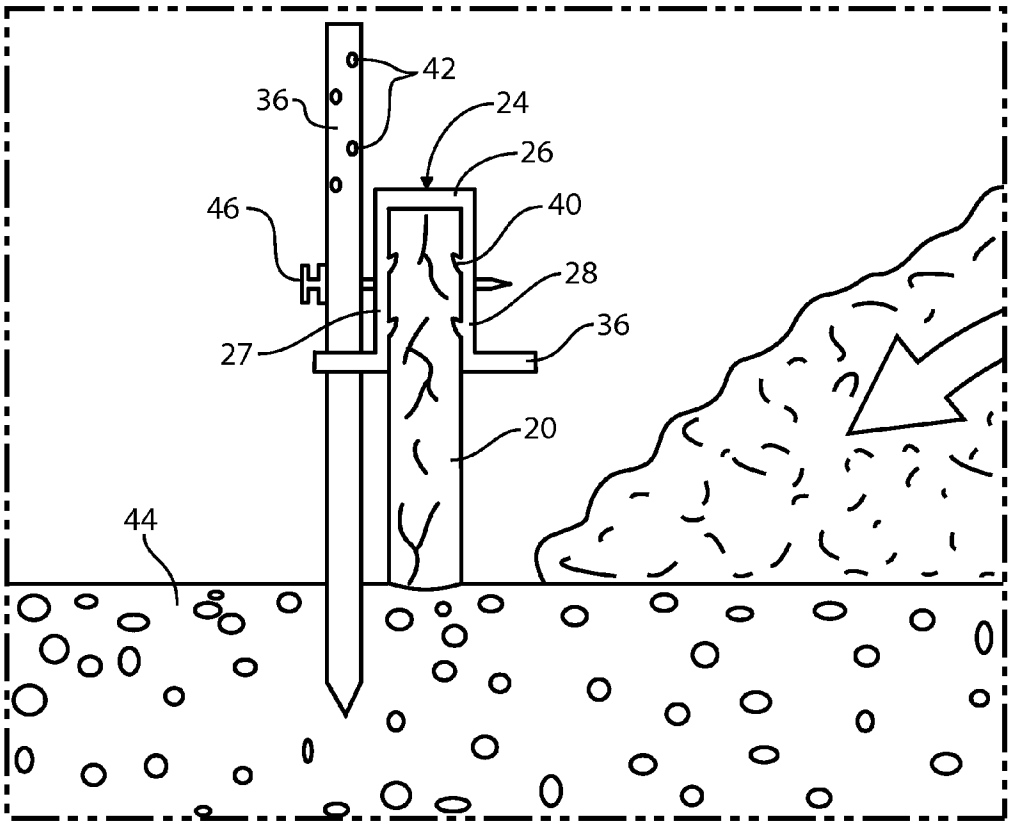
FIG. 3 is a fragmented perspective view of a segment of the expansion joint during installation.

Referring to FIG. 3 in conjunction with FIG. 2, it can be seen that open areas 32 are formed periodically in the side surfaces 27, 28 of the protective cap element 24. The open areas 32 on the opposite side surfaces 27, 28 of the protective cap element 24 are aligned. Each open area 32 preferably has a length of between two inches and six inches, and a height of at least ½ inch. As will be later explained, the open areas 32 are used to adjust the suspended height of the protective cap element 24 with respect to the anchor pins 34 that connect the protective cap element 24 to the ground.

Pin corrals 36 extend horizontally from the side surfaces 27, 28 of the protective cap element 24. The pin corrals 36 are located near the bottom of each side surface 27, 28. Each pin corral 36 is an elongated loop having a width at least as wide as the diameter of an anchor pin 34 and a length generally equal to the length of the open areas 32. Furthermore, the pin corrals 36 are aligned with the open areas 32 so that the opening defined by a pin corral 36 is aligned with an open area 32.

Mechanical connectors 38 are used to connect different segments of the protective cap elements in a linear orientation. Preferably, each protective cap element has a length of between six inches and ten feet. Sections of different sizes can be combined by a contractor to create a series of interconnected segments that reach a desired length. In this manner, the need to cut various segments to size is reduced. This significantly reduces labor and losses due to scrap.

In the shown embodiment, the mechanical connectors 38 include grooved receptacles 37 on the side surfaces 27, 28. A connector plate 39 is provided that engages the grooved receptacles 37 with a frictional fit, thereby interlocking adjacent segments of the protective cap elements 24. It will be understood that many mechanical connectors exist that can be adapted for use as part of this invention and that the use of a connector plate 39 and grooved receptacles 37 is merely exemplary.

The anchor pins 34 used to initially set the expansion joint 10 in place can be either wooden or metal. In the shown embodiment, the anchor pins 34 are metal pins. Holes 42 are formed through each anchor pin 34 at different points so that mechanical fasteners, such as nails, can be driven through the structure of the anchor pin 34.

Figure 4:
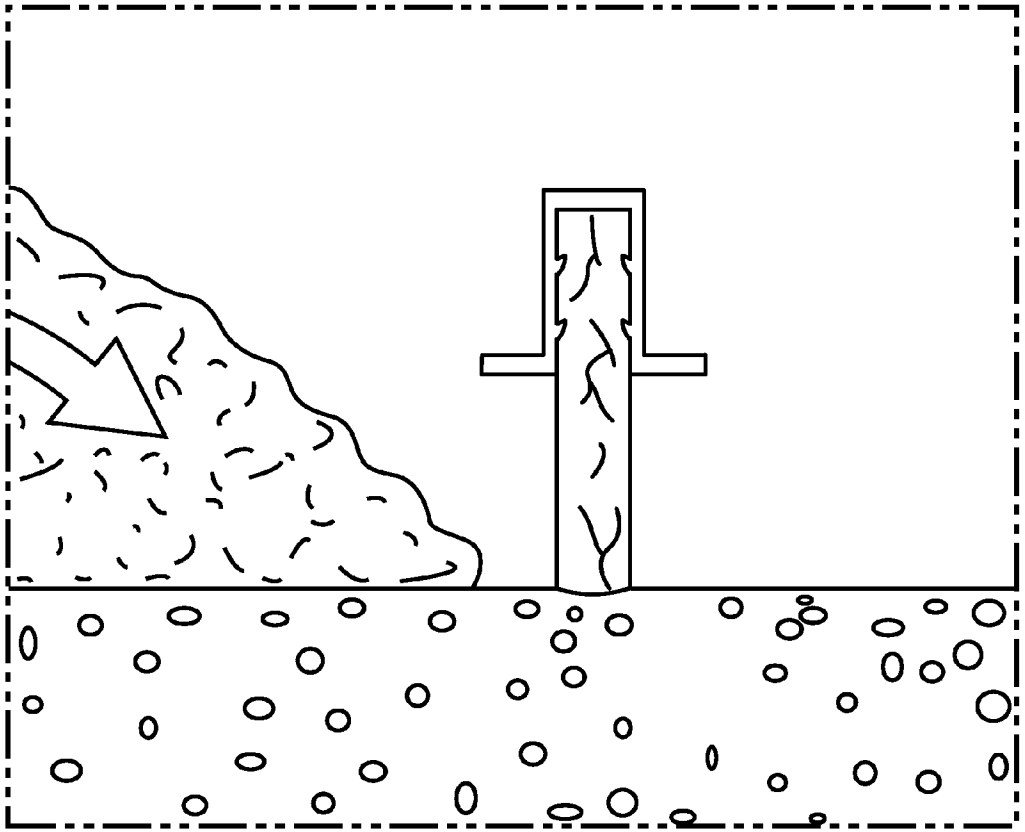
FIG. 4 is a cross-sectional view of the expansion joint during installation.

Referring to FIG. 3 in conjunction with FIG. 4, a methodology of utilizing the anchoring system 22 is explained. Initially, the ground is prepared to accept a pouring of concrete. Typically, this requires that the ground be properly graded and covered with a layer of aggregate, such as gravel 44.

A filler strip 20 is placed on the gravel 44 in the position where an expansion joint 10 is required. A length of protective cap element 24 is created that matches the length of the filler strip 20 and the length of the desired expansion joint 10. The filler strip 20 is placed inside the groove 30 defined by the protective cap element 24. Pointed projections 40 are optionally formed on the side surfaces 27, 28 of the protective cap element 24 in an orientation that faces the central groove 30. The pointed projections 40 allow the filler strip 28 to be inserted into the groove 30 of the protective cap element 24 but inhibits the removal of the filler strip 20 from the groove 30.

Once the protective cap element 24 is placed over the filler strip 20, anchor pins 34 are placed through the pin corrals 36 and are driven into the ground. Initially, the anchor pins 34 are not attached to the protective cap element 24 or to the filler strip 20. The overall expansion joint 10 can therefore be moved up and down along the height of the anchor pins 34. The expansion joint 10 is set at a desired height and at a desired slope relative to the ground. A nail, screw or similar fastener 46 is then passed through the anchor pin 34 and into the filler strip 20. Since the anchor pin 34 is in the pin corral 36, the anchor pin 34 aligns with the open areas 32 (FIG. 2) in the side surfaces 27, 28 of the protective cap element 24. Any fastener 46 driven through the anchor pin 34 can therefore pass directly into the filler strip 20 without having to pass through the material of the protective cap element 24. This prevents the protective cap element 24 from becoming damaged during installation.

Once the expansion joint 10 containing the filler strip 20 and the protective cap element 24 is set at a desired height and slope, concrete can be poured against the expansion joint 10. The poured concrete fills the pin corrals 36 and the open areas 32 of the protective cap element 10. Consequently, as the concrete hardens, the protective cap element 24 becomes permanently encased in the slab 13 of concrete.

Once the concrete hardens, the anchor pins 34 on the opposite side of the expansion joint 10 can be removed. Concrete can then be poured on the opposite side of the expansion joint 10. Because the expansion joint 10 is mechanically locked into the cured slab 13 of concrete, no pins are required to hold the expansion joint 10 in place. The second poured slab 12 of concrete then encases the opposite side of the expansion joint 10.

Referring back to FIG. 1 in conjunction with FIG. 2, the only part of the expansion joint 10 that does not become encased in concrete is the top surface 26 of the protective cap element 24 that covers the top edge 21 of the filler strip 20. The filler strip 20 is protected on its sides by the poured concrete and is protected on its top by the protective cap element 24. The filler strip 20 is, therefore, isolated from the weather and from the wear of passing feet, bicycle wheels, snow shovels and the like. The result is that the filler strip 20 remains intact and functional for a much longer period of time than does an exposed filler strip. The resulting slabs 12, 13 of poured concrete, therefore, require less maintenance and have a longer functional life than do traditional slabs.

During construction, a concrete slab may be required to be poured unusually thick. Consequently, the height of the expansion joint must be extended to match the thickness of the poured concrete. If a particular expansion joint requires a filler strip that is much taller than the height of the protective cap element, a single protective cap element may be insufficient to prevent the filler strip from warping as the thick concrete slab is poured.

Figure 5:
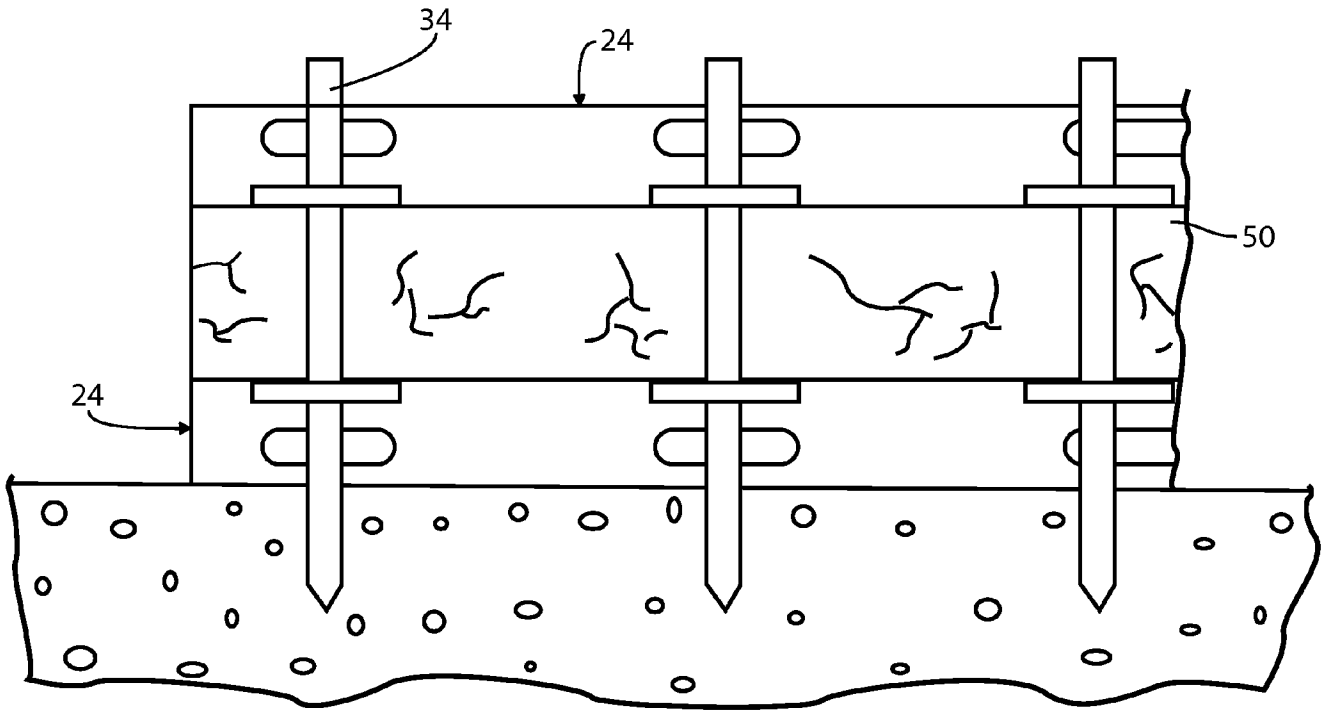
FIG. 5 is a side view of an alternate embodiment of an expansion joint.

Referring to FIG. 5, it will be understood that to support a tall filler strip 50, segments of a protective cap element 24 can be used both along the top edge 52 of the filler strip 50 and along the bottom edge 54 of the filler strip 50. Anchor pins 34 can be driven through the pin corrals 36 of both protective cap elements 24. The anchor pins 34 align the two sets of protective cap elements 24, thereby preventing either the top edge or the bottom edge of the filler strip 50 from warping out of alignment. The anchor pins 34 are removed once the concrete is poured along one side of the expansion joint and has cured.

In the embodiment of the present invention previously shown, the pin corals 36 are defined in part by a thick peripheral wall. To manufacture a pin coral in such a configuration requires complex tooling. To simplify the manufacturing of the protective cap element, the pin corals can be modified in design.

Figure 6:
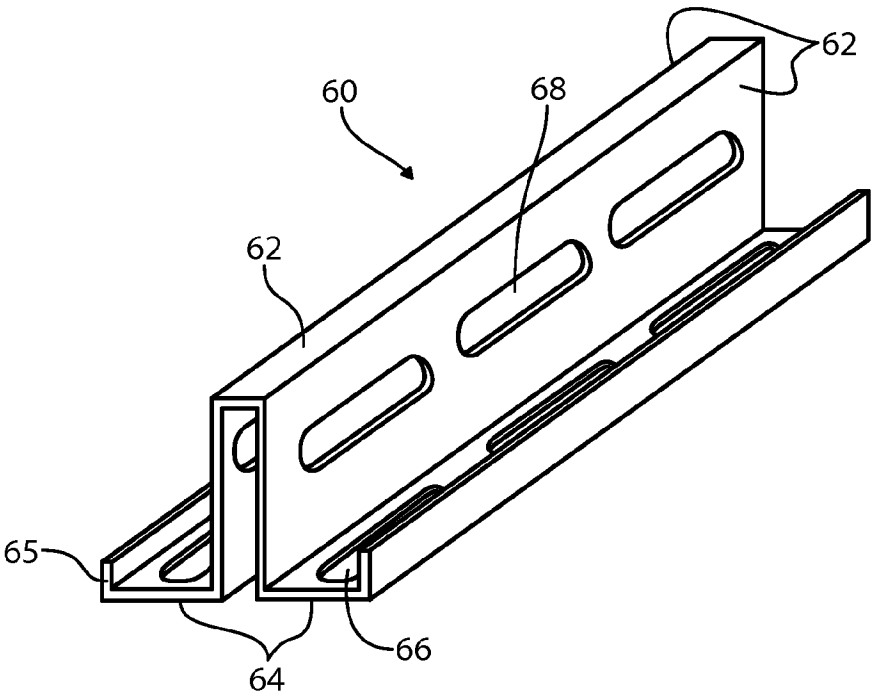
FIG. 6 is a perspective view of an alternate embodiment of a protective cap element in accordance with the present invention.

Referring now to FIG. 6, an alternate embodiment of a protective cap element 60 is shown. In this embodiment, the cap element 60 has a top surface 62 and opposing side surfaces 62. Flanges 64 extend outwardly at a perpendicular to the opposing side surfaces 62. The flanges 64 terminate with vertical lips 65. Holes 66 are punched in the flanges 64. This forms pin corals. The pin corals are used in the same manner as those in the previous embodiment. Holes 68 can also be punched through the opposing side surfaces 62 to allow for nailing.

By forming the protective cap element 60 with straight side flanges 64, it will be understood that the protective cap element 60 has a configuration that can be easily extruded. Thus, the protective cap element 60 can be manufactured inexpensively with complex injection molds.

It will be understood that the embodiments of the present invention that are illustrated are merely exemplary and that a person skilled in the art can make many variations to the shown embodiments using functionally equivalent components. For example, the mechanical connectors that join adjacent protective cap elements can be changed. Furthermore, the length, width and height of the pin corrals and windows can be varied. All such variations, modifications and alternate embodiments are intended to be included within the scope of the present invention as defined by the appended claims.

What is claimed is:

1. A method of setting an expansion joint between two adjacent slabs of poured concrete, said method comprising the steps of:

providing a filler strip having a top edge and a bottom edge;

providing a protective cap element that defines a groove between a top surface and two opposing side surfaces that include a first side surface and a second side surface, wherein a plurality of openings are formed through said side surfaces;

providing a plurality of anchor pins, wherein each anchor pin has a predetermined width;

providing a plurality of pin corrals that extend outwardly from said side surfaces, wherein each of said pin corrals defines an pin opening that is at least twice as wide as said predetermined width of each of said anchor pins;

placing said protective cap element over said filler strip so that said top edge of said filler strip and a segment of said filler strip proximate said top edge is disposed within said groove;

anchoring said protective cap element and said filler strip in a fixed position by driving anchor pins through at least some of said pin corrals along said first side surface of said protective cap element;

driving mechanical fasteners through said anchor pins and into said filler strip through said plurality of openings, wherein said mechanical fasteners temporarily retain said protective cap element and said filler strip in said fixed position where said top edge of said filler strip faces vertically upward; and pouring concrete against said filler strip and said second side surface of said protective cap element, wherein said concrete envelops said pin corrals along said second side surface and locks both said protective cap element and said filler strip into said fixed position.

2. The method according to claim 1, wherein said step of pouring concrete against said filler strip and said second side of said protective cap element includes the substeps of:

waiting for said concrete to set;

removing said anchor pins; and pouring concrete against said first side of said filler strip and said protective cap element.

3. The method according to claim 1, wherein said step of providing a protective cap element includes the substeps of:

providing a plurality of segments of said protective cap element;

interconnecting said plurality of segments to achieve an assembly having a length at least as long as said predetermined length of said filler strip.

4. The method according to claim 1, further including the step of providing a second protective cap element.

5. The method according to claim 4, further including the step of placing said second protective cap element over said bottom edge of said filler strip.

6. In an expansion joint containing a filler strip that is set between two adjacent slabs of poured concrete so that only a top edge of the filler strip is exposed, a method of protecting said filler strip comprising the steps of:

providing a plurality of anchor pins, wherein each of said pins has a maximum width;

providing a protective cap element that defines a groove between a top surface and two descending side surfaces, that include a first side surface and a second side surface;

providing elongated pin corals that extend outwardly from said side surfaces, wherein each of said elongated pin corals defines an opening at least twice as wide as said maximum width of said anchor pins;

placing said protective cap element over said filler strip so that said filler strip is at least partially disposed within said groove and said top edge of said filler strip is covered by said top surface of said protective cap element;

temporarily anchoring said protective cap element over said filler strip by driving said anchor pins through at least some of said pin corrals on said first side surface of said protective cap element; and setting said protective cap element into one of said adjacent slabs of poured concrete by pouring concrete against said second side surface of said protective cap element, wherein said concrete envelops said pin corrals along said second side surface, therein locking said protective cap element into place.

7. The method according to claim 6, further including the steps of:

connecting said filler strip to at least some of said anchor pins.

8. The method according to claim 6, further including the steps of waiting for said concrete to set;

removing said pins; and pouring concrete against side first side of said protective cap element.

9. The method according to claim 6, wherein said step of providing a protective cap element includes providing a protective cap element with periodic openings in said side surfaces.

10. The method according to claim 6, wherein said step of temporarily anchoring said protective cap element over said filler strip further includes connecting said anchor pins to said filler strip with mechanical fasteners.

* * * * *